US005799230A

United States Patent [19]

Lloyd

[11] Patent Number: 5,799,230

[45] Date of Patent: Aug. 25, 1998

[54] COMPACT ELECTROPHOTOGRAPHIC COLOR DEVELOPER MODULE

[75] Inventor: Michael B. Lloyd, Boise, Id.

[73] Assignee: Hewlett-Packard Company, Palo Alto, Calif.

[21] Appl. No.: 823,276

[22] Filed: Mar. 24, 1997

[51] Int. Cl.[6] ..... G03G 15/00

[52] U.S. Cl. ..... 399/107; 399/223; 399/302

[58] Field of Search ..... 399/112, 121, 399/223, 228, 302, 107, 118, 119; 347/232, 263

[56] References Cited

U.S. PATENT DOCUMENTS

| | | | |
|---|---|---|---|
| 4,515,460 | 5/1985 | Knechtel | 399/302 |
| 5,138,389 | 8/1992 | Randall | 399/302 |
| 5,212,532 | 5/1993 | Storlie | 399/167 |
| 5,298,946 | 3/1994 | Haneda et al. | 399/112 |
| 5,666,599 | 9/1997 | Miyasaka et al. | 399/162 |

FOREIGN PATENT DOCUMENTS

| | | |
|---|---|---|
| 3-137659 | 6/1991 | Japan . |
| 5-249796 | 9/1993 | Japan . |
| 7-146597 | 6/1995 | Japan . |
| 7-253699 | 10/1995 | Japan . |
| 7-261568 | 10/1995 | Japan . |

*Primary Examiner*—Robert Beatty

[57] ABSTRACT

Embodiments of a compact electrophotographic color developer module are shown and described, each embodiment including generally vertically-oriented, self-contained developers, stacked or radially fanned-out above the photoconductor drum. The developers are preferably either wedge-shaped or rectangular, and preferably have cylindrical sleeves less than about 2 inches apart. The compact developer module and cooperating image transfer system have a small form factor and footprint and may be used in a wide variety of electrophotographic platforms with minimal changes. A cam system may be included to allow either contact, non-contact, or close-jump-gap development, with a simple code or ROM change. The photoconductor drum is sized to carry less than a complete image, because the image is transferred to an intermediate transfer member before transfer to paper. With extension of the developer canisters and/or of the intermediate transfer member, the system may be easily adapted for increased toner capacity, life and media size, respectively, with minimum or no effect on form factor and footprint. With extension of the width of photoconductor drum and transfer belt components, the system may be easily adapted for portrait or landscape media orientations.

12 Claims, 9 Drawing Sheets

COMPACT ELECTROPHOTOGRAPHIC COLOR DEVELOPER MODULE

FIELD OF THE INVENTION

Embodiments of the present invention relate to electrophotographic (EP) development stations. More specifically, the present invention relates to a compact color development module that can be applied to a wide variety of EP engine platforms, speeds, and media sizes.

BACKGROUND OF THE INVENTION

EP Process Overview

A schematic diagram of a generalized electrophotographic print engine 10 is shown in FIG. 1. The photoconductor 12 comprises a conductive drum coated with a photoconductive coating, which allows storage of a persistent charge across small elements of its surface 14. The photoconductor surface 14 is initially charged to some potential $V_C$ at the charging station 16. A modulated light beam at the exposure station 18 is then moved across the photoconductor surface 14, selectively discharging regions to some residual voltage $V_D$. This selective exposure writes a latent image on the photoconductor surface 14. In "discharge area development", the discharged areas are the regions that are to receive toner, whereas the charged areas, retaining a voltage near the initial charge level $V_C$, are the regions that are to remain un-toned (white).

After leaving the exposure station 18, the exposed surface of the photoconductor is rotated past a development station 20, which comprises a developer electrode that is biased to voltage $V_{DEV}$ referenced to the photoconductor. In FIG. 1, the developer electrode comprises a cylindrical development sleeve positioned against or near the photoconductor surface 14. Toner, comprising charged pigment particles, is brought in between the development sleeve 22 and photoconductor 12 to fill a nip or gap 26 between the two member's surfaces. Toner may comprise dual component toner, such as 40–50 micron ferrite particles and 5–15 micron toner particles, or single component 3–12 micron toner particles, for example.

The biased development sleeve 22 forms an electric field in the region of the toner-filled nip or gap 26. Charged toner particles in the development nip or gap are attracted toward the discharged areas of the photoconductor surface, thus, developing toner onto the discharged areas of the photoconductor surface to create a toner image.

In an alternative EP engine, such as is typically used in photocopiers, the exposure station writes a background image onto the photoconductor surface, for example, by reflecting light off of the white background of an original image. In such a system, the relative charges of the development sleeve and toner are designed to attract the toner to the charged areas rather than the discharged areas, thus developing the charged areas to create the toner image.

In either type of system, the toner image on the photoconductor surface 14 is then transferred to paper or other media at the image transfer station 30. Image transfer may be direct transfer from photoconductor to media, or may be indirect transfer. Indirect transfer typically comprises transfer of the image or one or more planes of a color image to an intermediate transfer (IT) member and then to the media. In indirect transfer, the IT member typically is large enough to hold the entire image plane at one time.

After the transfer of the image off of the photoconductor, the photoconductor surface typically advances to a cleaning station 32. The cleaning station 32 removes residual toner from the photoconductor before the next cycle.

In the case of color printing, a cycle of cleaning, exposure (writing), and development is repeated for each color plane in the image. Thus, three or four cycles are used for a color systems, also called "multi-color" or "multiple-development" systems, which typically comprise cyan, yellow, magenta, and usually black (c,y,m,k).

Contact vs. Non-Contact Development Stations

Conventional development stations typically are designed either for non-contact ("jump-gap") development or contact development. In non-contact development, the conductive, cylindrical developer sleeve is separated from the photoconductor surface by a small gap, which is typically in the range of 200–500 microns. A cloud of toner particles is typically generated in the gap using an AC voltage (Vac) applied to the DC offset $V_{DEV}$. In contact development, the developer sleeve rotates against the photoconductor surface 14. Toner is typically applied to the surface of the rotating sleeve, which then rotates the toner between the sleeve and the photoconductor, and a bias voltage is applied to the sleeve. In both non-contact and contract development, various transport and metering components may be used to apply toner to or near the sleeve surface, including rollers, augers, paddles, blades or mixers, for example.

Jump-gap development is more susceptible to fringe effects and gaps between color fields than is contact development. These fringe effects and gaps appear as blurred image edges and result from imprecise toner development caused by lateral electric field effects between exposed and unexposed areas on the photoconductor surface 14.

In the multiple-development systems of color printers, the fringe effects and gaps of jump-gap development may be magnified, depending on the development and transfer means employed in the process.

Although contact development may exhibit the benefit of increased image sharpness, it can be mechanically more complicated than jump-gap development in a multi-color process. This complication is due to the fact that the individual development stations for each color must be engaged and disengaged from the photoconductor surface to affect the contact development of the individual color planes.

Color Engine Form Factors

Conventional color EP processes follow the general process outline above, with the development station typically comprising four color developers, that is, one for each of the toner colors yellow, magenta, cyan, and black. The necessity of four separate developers, along with means for engaging and disengaging them and methods for transporting toner to the development sleeve, typically gives the color development station a large form factor and the resulting printer a large footprint, which is a drawback in the current drive for compact EP printers that take up little desk-top space. The footprint for a printer or a part of a printer (a developer, for example) is herein defined as the area defined at its perimeter by the horizontal extent of the printer or a part of the printer, respectively, as may be apparent from a top plan view. The size, shape and placement of individual parts of a printer impact the overall footprint of a printer, and, thus, the space the printer requires on a desk or table. Form factor for a part of a printer is herein defined as the shape of the printer or printer components and the volume of space that the shape requires.

Examples of commercial color engines are shown in FIGS. 2–5 and described below:

FIG. 2 schematically illustrates a color EP development station, having four developers with separate toner supply canisters disposed beside a large, cylindrical photoconductor. This development engine consists of a 2-part toner system. Non-ferritic pigmented toner particles (in the toner supply canisters) are transported to the developer where angers are used to mix and charge the toner particles with ferritic particles that reside in the developer. This system is large and complex and requires mechanisms and seals for containing and moving the toner from supply reservoir to the developer. The photoconductor in this direct-to-drum imaging system is large due to the fact that it must be able to receive on its surface the entire image corresponding to the printer's largest paper size in addition to intermediate surface area required for page-to-page electrophotographic timing issues.

FIG. 3 schematically illustrates a conventional color EP development station having four color developers aligned linearly along an elongated photoconductor (PC) belt. In this indirect-transfer system, planes of color are transferred from the PC belt to the intermediate transfer (IT) drum and then, once all planes are layered on the IT drum, from the IT drum to paper or other media. The photoconductor belt is sized to be longer than the total width of the four side-by-side developers. As in the previous embodiment, the IT drum must be sized to receive the entire image corresponding to the printer's largest paper size, in addition to intermediate surface area required for page to page electrophotographic timing issues. The resulting large diameter of the IT drum results in a large volume of unusable space in the printer.

FIG. 4 schematically illustrates another indirect-transfer system, in which color canisters are aligned along an elongated photoconductor belt. An elongated intermediate transfer belt extends beside and down past an end the photoconductor belt, for transfer of color planes to paper. Again, in this system, the photoconductor belt is long enough to extend along the width of the 4 canisters, and the transfer belt has a total circumferential length sufficient to hold a complete image for the printer's largest paper. The presence of belts for both photoconductor and IT member creates severe belt tracking, belt alignment and color plane registration problems, resulting in poor image quality.

FIG. 5 schematically illustrates a carousel-style development station. Four developers are arranged around a carousel, which rotates to sequentially place each color developer against the photoconductor. The photoconductor rotates against a large IT drum. The IT drum has a circumference large enough to receive color planes for an entire image for the printer's longest paper, plus additional circumference for intermediate space to accommodate the swing of the carousel between colors.

Still, there is a need for a development module design that is compact and usable in a wide variety of printer platforms with minimum or no changes. There is a need for a such a development engine that has a small footprint and form factor, to fill the need for printers which take up little space on a desk top. There is a need for a development imaging system that simplifies the mechanisms, motors and drives necessary to that system without sacrificing image quality or flexibility in leverage to multiple print engine platforms using either contact or jump gap development.

SUMMARY OF THE INVENTION

The present invention comprises a compact dry electrophotographic color module with a small form factor and footprint. The invented module is designed for either contact or non-contact development without changes to the basic configuration of the module. The color module of the present invention is usable with many EP printer engine platforms and paper handling configurations.

The invented module and its cooperating image transfer system has the potential to become a universally-applicable system, replacing the conventional approach of having various development modules in both contact and non-contact systems for each media size, toner capacity (development life), and media orientation (landscape vs portrait). The invented system offers this universality because of three preferred areas of adaptability:

1) The system can support various media sizes (letter, legal, A-4, etc.) by a simple change in the length of the intermediate transfer belt member. This length change does not exponentially increase the volume of the EP engine as in the case of systems employing drums that must contain the entire image.
2) The system can support various development lives and resulting engine platforms by only extending or changing the form factor of the developer cartridges. This extension can be accomplished without changing the size or shape of interrelated components.
3) The systems can integrate either contact or non-contact development with the addition of one simple CAM and a ROM or code change.

Various features of the invented EP engine contribute to a more compact, vertically-oriented system, and, therefore, to a smaller form factor and footprint than conventional EP engines. The invented development module preferably cooperates with a small OPC drum, designed to hold only a portion of an image plane at any one time, but also could be used with larger, longer life OPC drums, if desired. The invented development module comprises a plurality of color developers arranged generally radially around approximately half of the circumference of the OPC, with cylindrical developer electrodes radially arranged and closely adjacent to each other, that is, preferably less than about one to two inches apart at their centers. The other process stations, such as the intermediate transfer (IT) member, waste toner removal station, and charging station, are positioned around the other half of the OPC, generally opposite the developers. Preferably, the IT member and laser scanner are on either side of the OPC at angles greater than 45° above horizontal to create a "V" configuration around the bottom half of the OPC.

Preferably, the color developer canisters are elongated and their longitudinal axis are disposed generally vertically, that is, at greater than about 45° above horizontal. Preferably, the canisters' front and back horizontal extents lie on a plane that intersects the OPC drum axis and that is greater than 45° above horizontal. The canisters may be, for example, wedge-shaped canisters fanning-out above the OPC or thin, box-shaped canisters layered above the OPC. The developer canisters are designed to "stack", that is, to match or mate at their outer surfaces with little or no space between the developer canisters, so that the four developers take up a minimum of total space.

The developer canisters length may be increased to increase toner capacity without significantly increasing the system footprint, and, in the case of wedge-shaped canisters, such a length increase results in even larger increases in volume to greatly increase toner capacity. For example, for a wedge-shaped canister of a set width (direction into paper on FIG. 6) and set approximately 45° wedge angle, a doubling of the height (herein also called length (L)) approximately triples the volume of the canister. Thus, a fairly small increase in height greatly increases volume, with relatively little effect on footprint.

DETAILED DESCRIPTION OF THE PREFERRED EMBODIMENTS

Referring to FIGS. 6–9, there are shown several, but not the only, embodiments of the invented compact EP color development module and EP print engine. The invention may be produced, in effect, as a modular system that can be "inserted" into many different printer platforms. This modular, single-design approach can save the significant expense of designing different configurations for every printer and can save space inside the printer and, hence, on the desk-top. In FIGS. 6–9, the front and back of the EP engine are at the left and right of the figure, respectively and the width of the print engine is into the paper.

Figure 1:
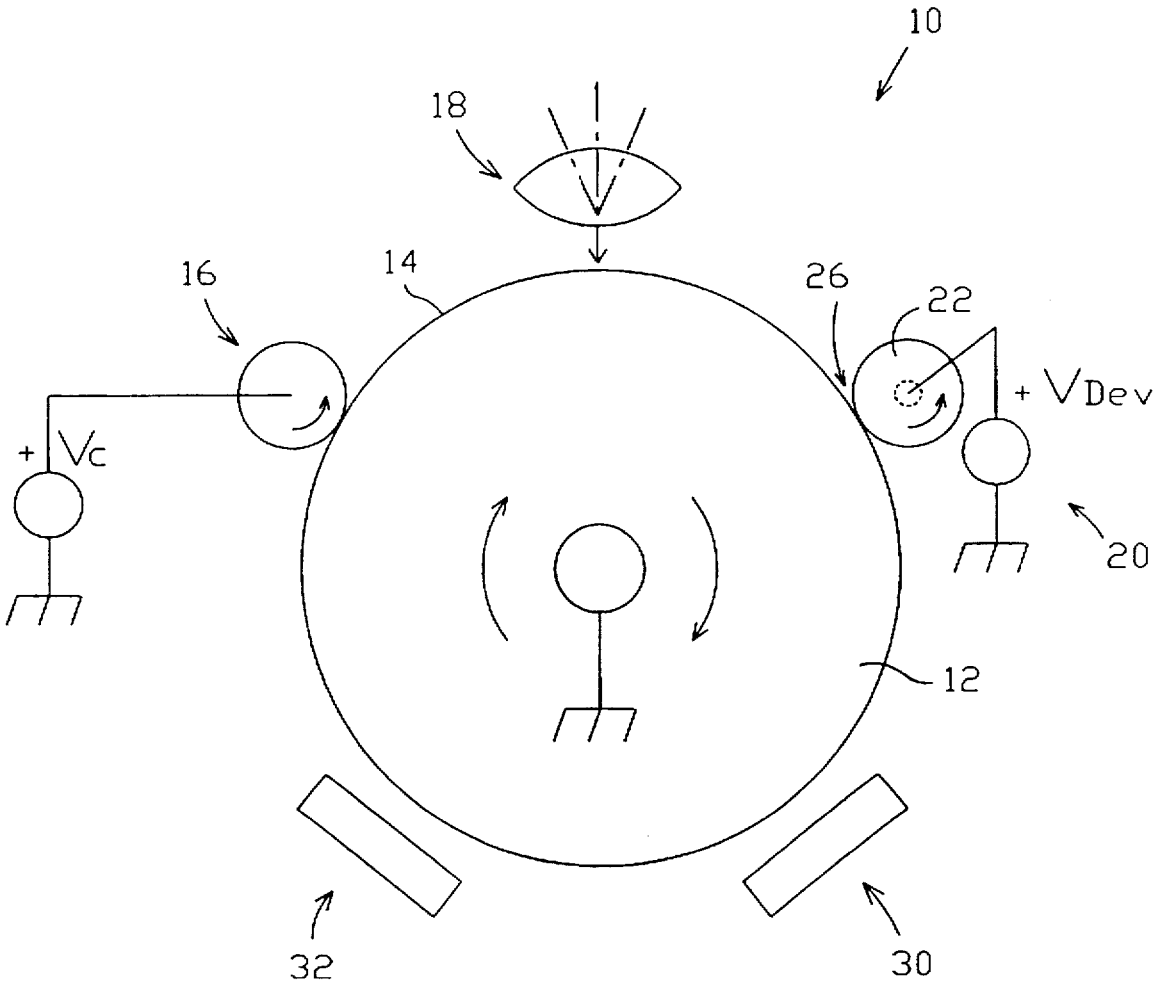
FIG. 1 Prior Art
FIG. 1 is a simplified, generalized schematic of a EP engine, with the developer electrode shown as a rotary cylinder.
Figure 2:
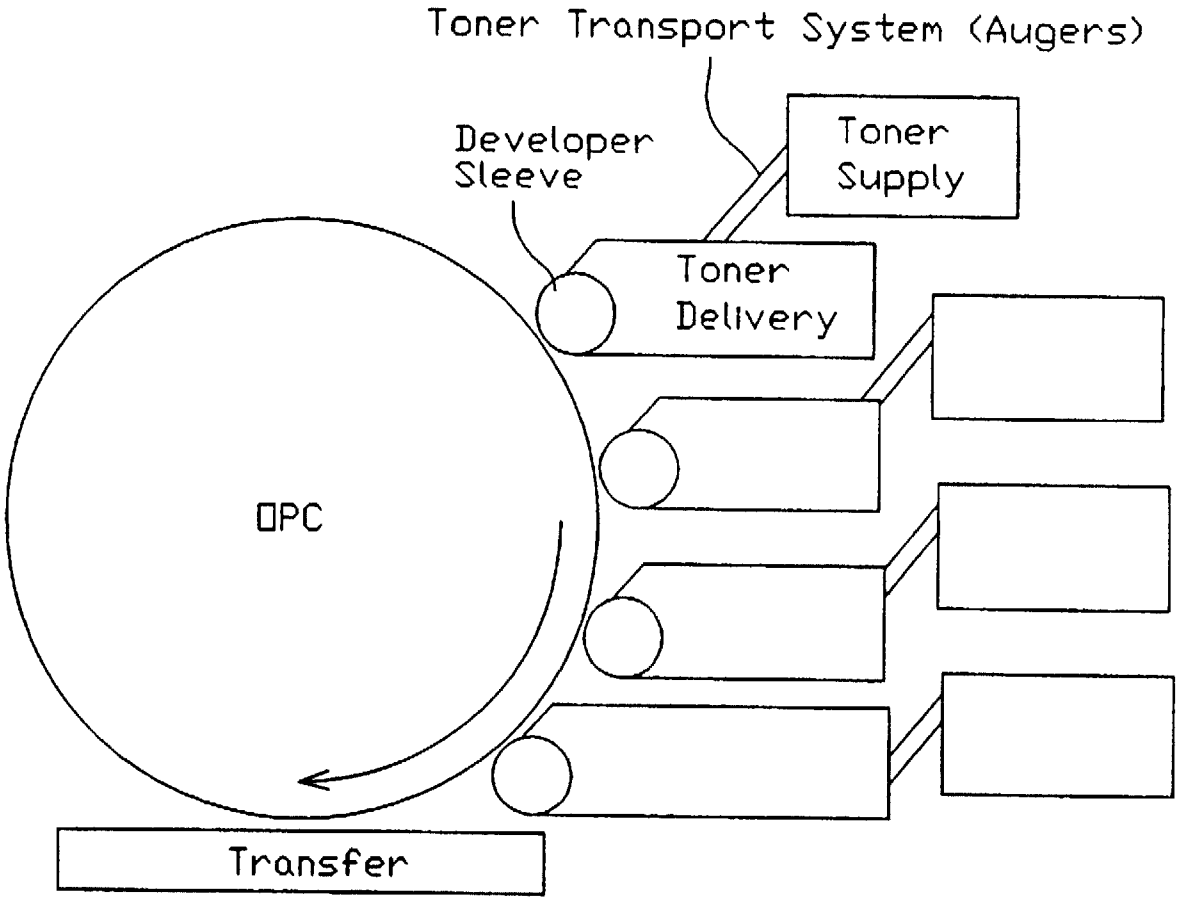
FIG. 2 Prior Art
FIG. 2 is a schematic view of a direct-to-paper EP development station, according to the prior art, having four off-board auger-fed developers disposed around a large OPC drum, each developer having an attached toner supply system and a toner delivery system for delivering toner to the developer.
Figure 3:
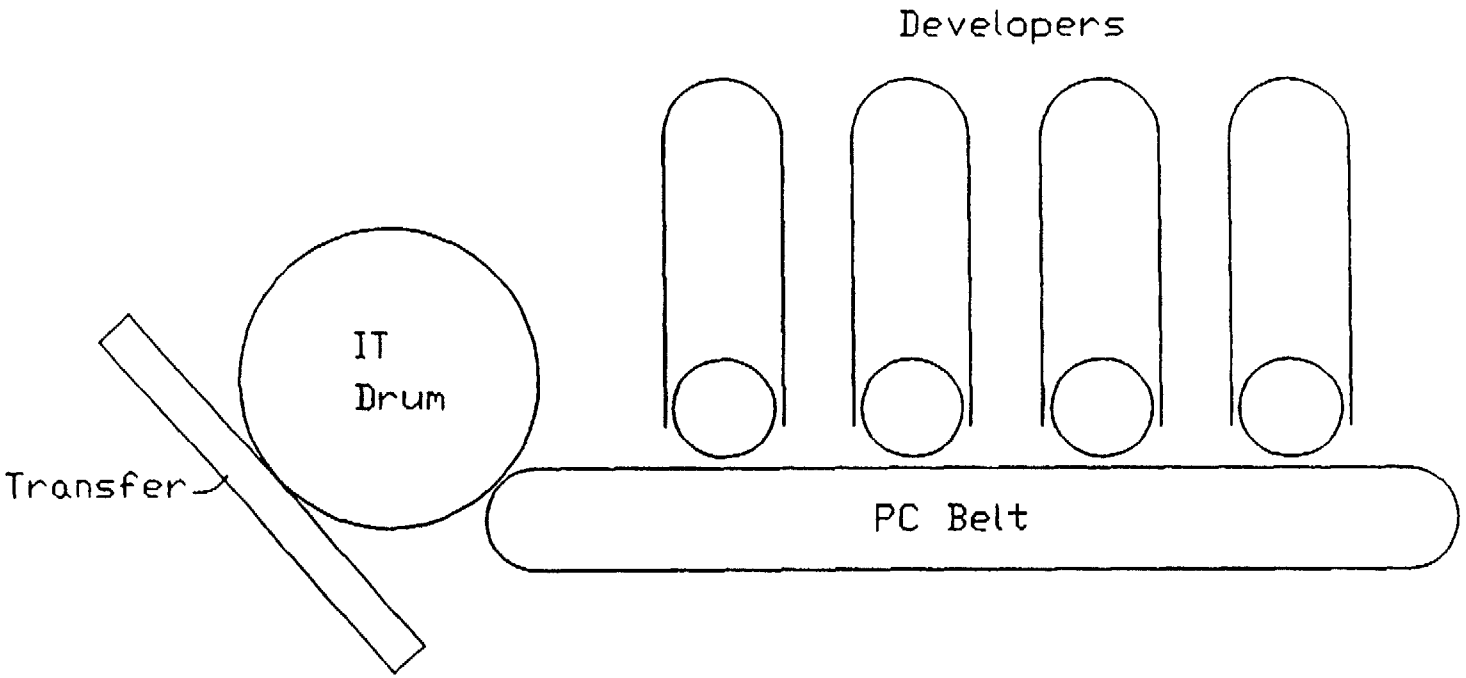
FIG. 3 Prior Art
FIG. 3 is a schematic view of another prior art EP development station, including developers aligned linearly along a PC belt and including an intermediate transfer drum.
Figure 4:
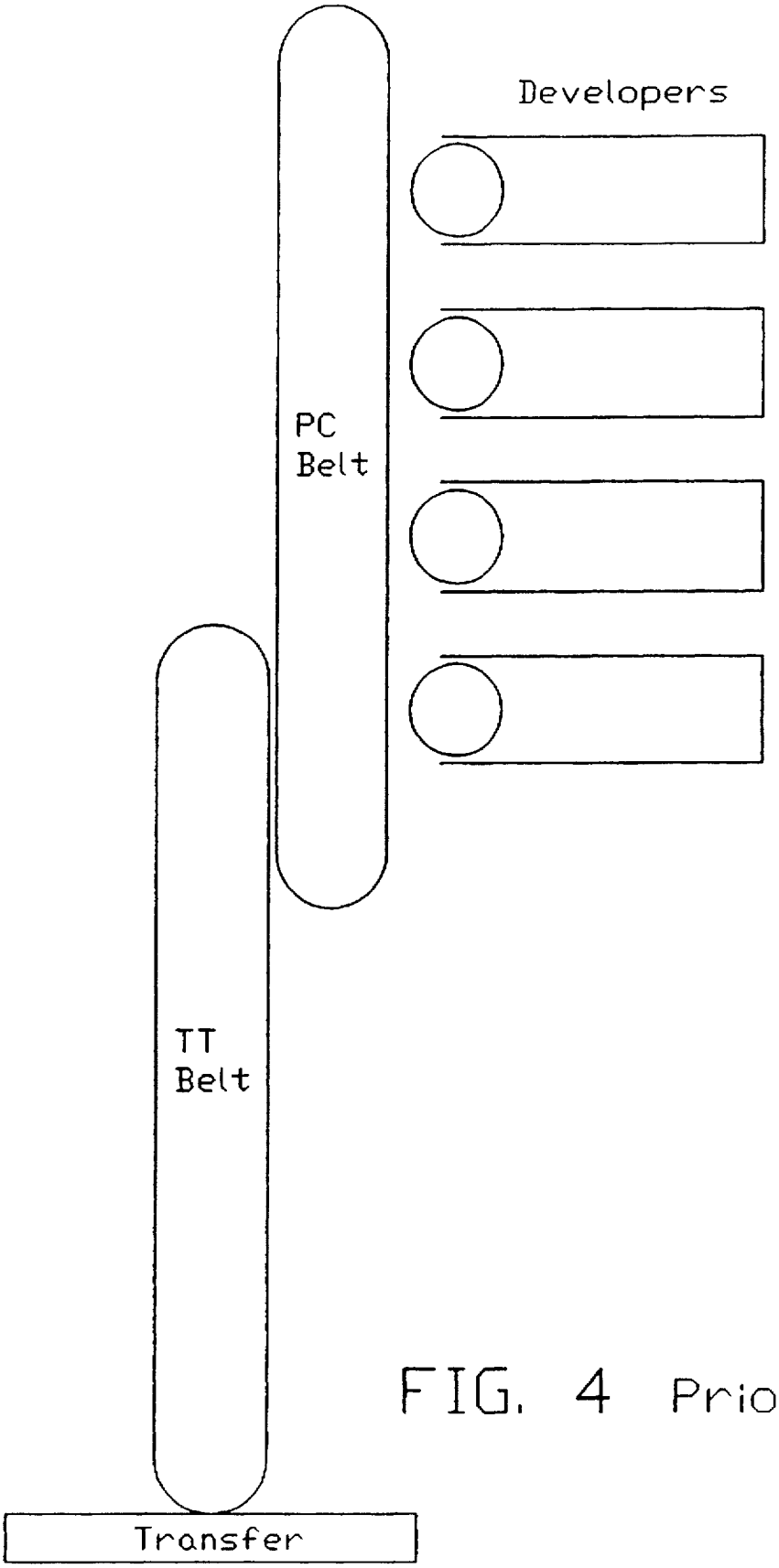
FIG. 4 Prior Art
FIG. 4 is a schematic view of another prior art EP development station, featuring belts for both the PC and the intermediate transfer member.
Figure 5:
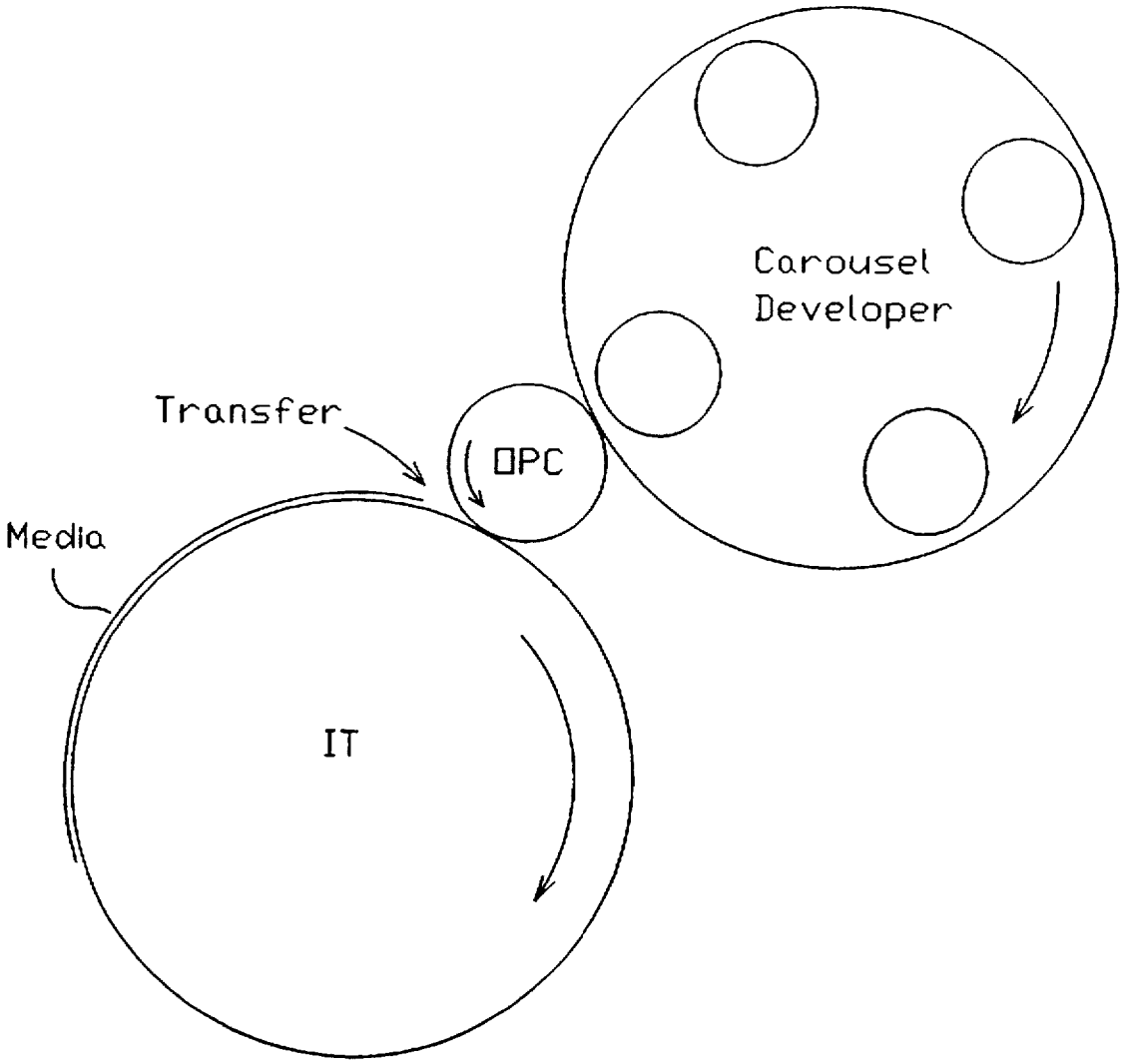
FIG. 5 Prior Art
FIG. 5 is schematic view of a prior art carousel-style EP development stations, with transfer to media attached to a full size drum.
Figure 6:
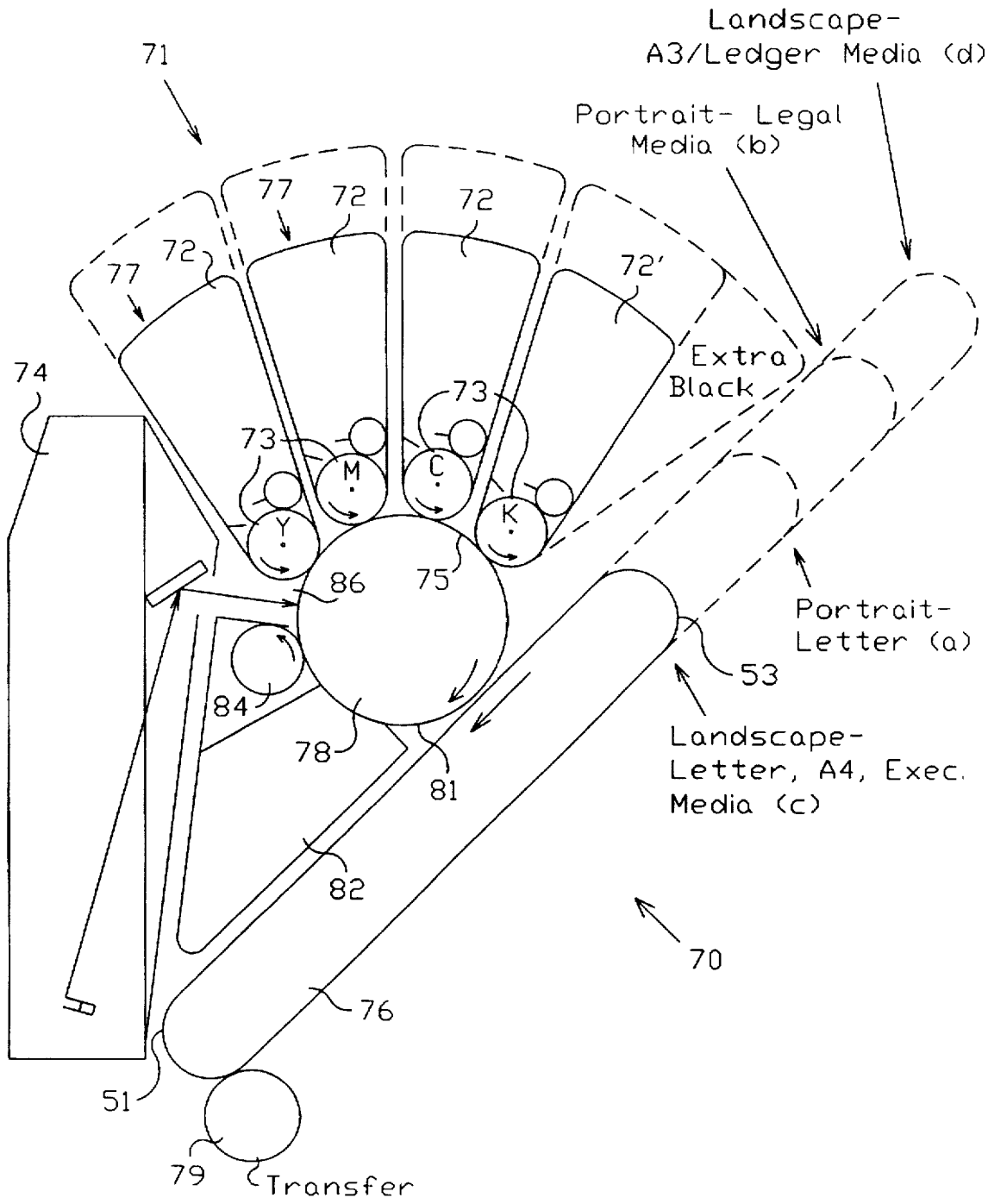
FIG. 6 is a schematic side view of the preferred embodiment of the invented V-configured compact EP color development module and EP engine, including wedge-shaped canisters.

The preferred embodiment of the invented EP engine 70, shown in FIG. 6, is designed generally in a V-shaped configuration. This V-configuration creates a compact, vertically-oriented system, compared to conventional large, horizontally-oriented systems. In this configuration, the development module 71 comprises four developers 77, each developer 77 comprising a wedge-shaped canister 72, 72' and a cylindrical development sleeve 73. The canisters 72, 72' are above the top half 75 of the OPC drum 78 circumference and are fanned-out between the planes of the laser scanner 74 and the IT belt 76. The laser scanner 74 may be considered the left-hand leg of a V, and the IT belt 76 may be considered the right-hand leg of the V.

Preferably, the four developers 77 are independent, so that one developer may be changed out at a time. Preferably, at least three of the developer canisters 72 are identical in design so that a single design may be applied for a plurality of the colors, minimizing the complexity and expense of manufacturing and packaging. The wedge shape of the canisters 72 features narrow bottom ends that fit around a small segment of the OPC drum 78 circumference, and larger top ends that increase toner capacity. All of the canisters 72 may be designed to be extended in length, as shown by the dashed lines, for greater toner capacity. The black canister 72' may have a greater depth or an irregular shape to increase volume and black toner capacity without significantly increasing the footprint.

The IT belt 76 is an elongated belt, positioned on a side of the OPC drum 78 opposite from the canisters 72, 72', that is, generally near the bottom half 81 of the OPC drum 78. The IT belt 76 is preferably angled at greater or equal to 45° above horizontal, but may be angled at any angle between 5° to 90°, for example 45°–80° relative to horizontal and may be in front of or in back of the developers (i.e., as shown in FIG. 6, or as in a mirror image of FIG. 6). For landscape-letter printing, the IT belt 76 may have front and back horizontal extents 51, 53 that do not extend out horizontally further than the front and back horizontal extents of the canisters, as shown by the "c" IT belt configuration in FIG. 6. For portrait or long specialty paper needs, the IT belt 76 may extend up beside the developer canisters 72, 72'. Portrait extensions (from a to b in FIG. 6) or landscape extensions (from c to d in FIG. 6) are done solely by changing the length of the IT belt 76. The image from the IT belt 76 is transferred to print media at the transfer station 79, near the point of the V.

The waste toner removal station 82 comprises preferably a V-shaped canister positioned generally near the point of the V and contacting the OPC drum 78 to clean the drum. A charge roller 84 and a space for the laser exposing beam 86 are positioned between the waste removal station 82 and the first (yellow) developer 72.

The OPC drum 78 of engine 70 typically is less than 6 inches in diameter, preferably about 2–4 inches in diameter, and the four cylindrical development sleeves 73 are preferably about 1 inch-2 inches apart at their central axes. The drum 78 need be large enough to accommodate contact by the four development sleeves 73, the cylindrical charge roller 84, elongated IT belt 76, and waste station 82, and to accommodate space for the laser exposure beam 86. The OPC drum 78 need not be large enough to hold an entire image at one time, because the image planes are transferred to the IT belt 76 within a fraction of a rotation after development and then held by the IT belt until transfer to the print media. By using a thin, elongated IT belt 76 to hold the various color image planes instead of using a cylindrical drum, or multiple belts, the total volume required for the EP module is reduced.

Figure 7:
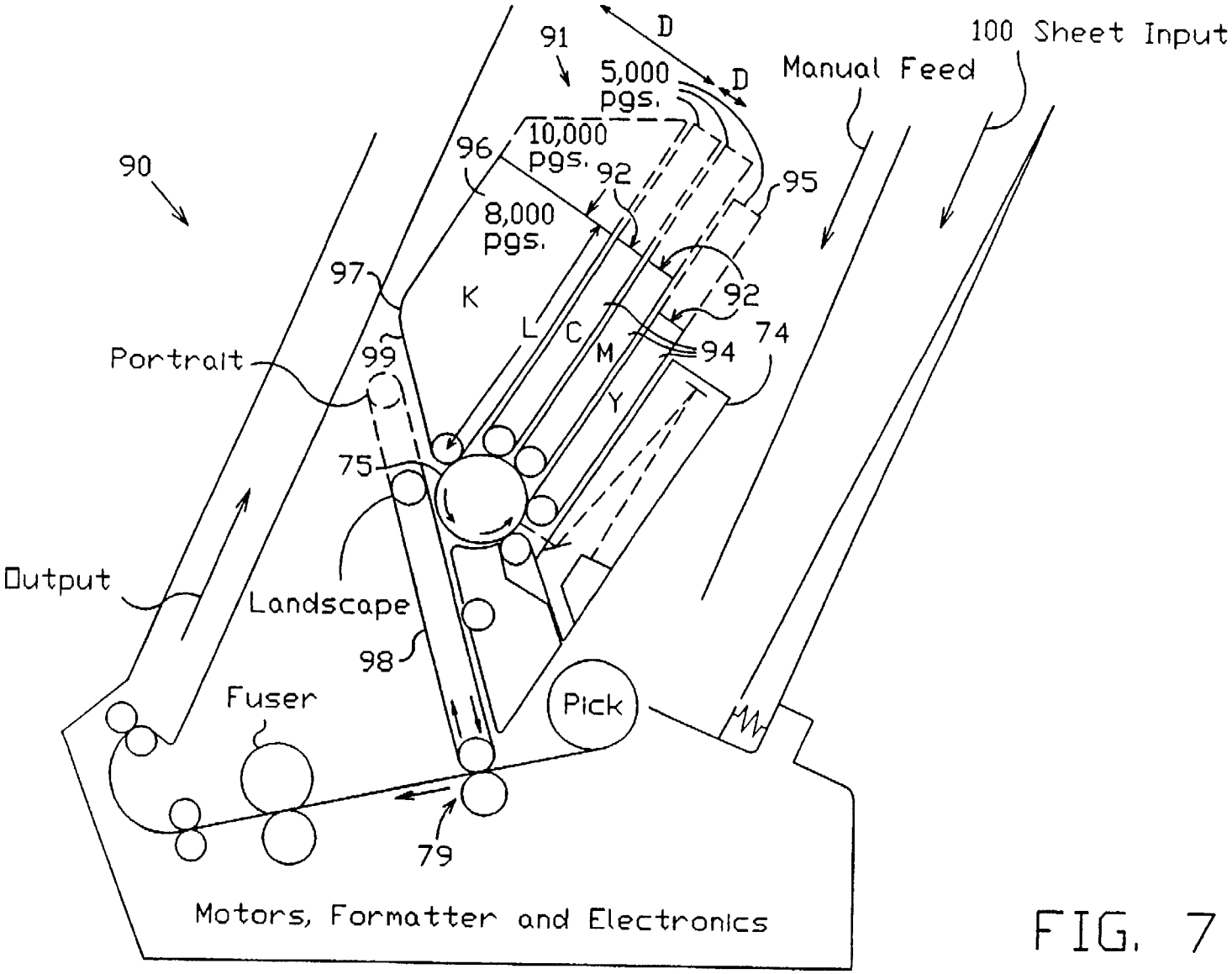
FIG. 7 is a schematic side view of another embodiment of the invented compact EP color development module, a V-configuration development module incorporated into an existing small format monochrome engine.

FIG. 7 illustrates an engine 90 comprising a V-configuration compact module 91 inserted into a small format monochrome engine. The module 91 comprises thin components layered in a V-orientation, so that its footprint, in a side view, corresponds to the widest part of the "V".

In module 91, three of the four developers 92, for cyan, magenta, and yellow, have canisters 94 that each are generally a thin, rectangular box shape, that is, they have a height or length (L) and width that are significantly greater than their depth (D). The width of the canisters 94, in the direction into the paper in FIG. 7, is typically about 9–10 inches for portrait orientation platforms or 12–13 inches for landscape orientation platforms. The canisters are stacked and positioned with their longitudinal axes generally at about 60°–80° above horizontal, to minimize the overall depth of, and, hence, the footprint of the developers. The IT belt 98 is angled at about 65°–75° above horizontal and extends up beside an angled side 99 of the black toner canister 96. All the canisters 92, 96 may be extended in length for greater toner capacity, as shown by the dashed lines. The laser scanner 74 has a longitudinal axis that is disposed greater than 45° above the horizontal.

In order to allow gravity feed toner flow through the canisters to the developer sleeve, the front and back outer extremities of all canisters of the invented color development module preferably lie at greater than or equal to 20° above horizontal. In order to decrease the footprint of the canisters, the preferred canisters are positioned with their longitudinal axes disposed at greater than 45° above horizontal, and also with their front and back outermost extremities (front and back horizontal extent) lying in planes through the OPC drum axis that are greater than 45° above horizontal. For example, in the case of the embodiment of FIG. 7, the back corner 95 of the yellow canister is disposed at about 55°–60° from the horizontal. Also, the front corner 97 of the black canister 96 lies on a plane intersecting the drum axis at about 65° above horizontal.

Figure 8:
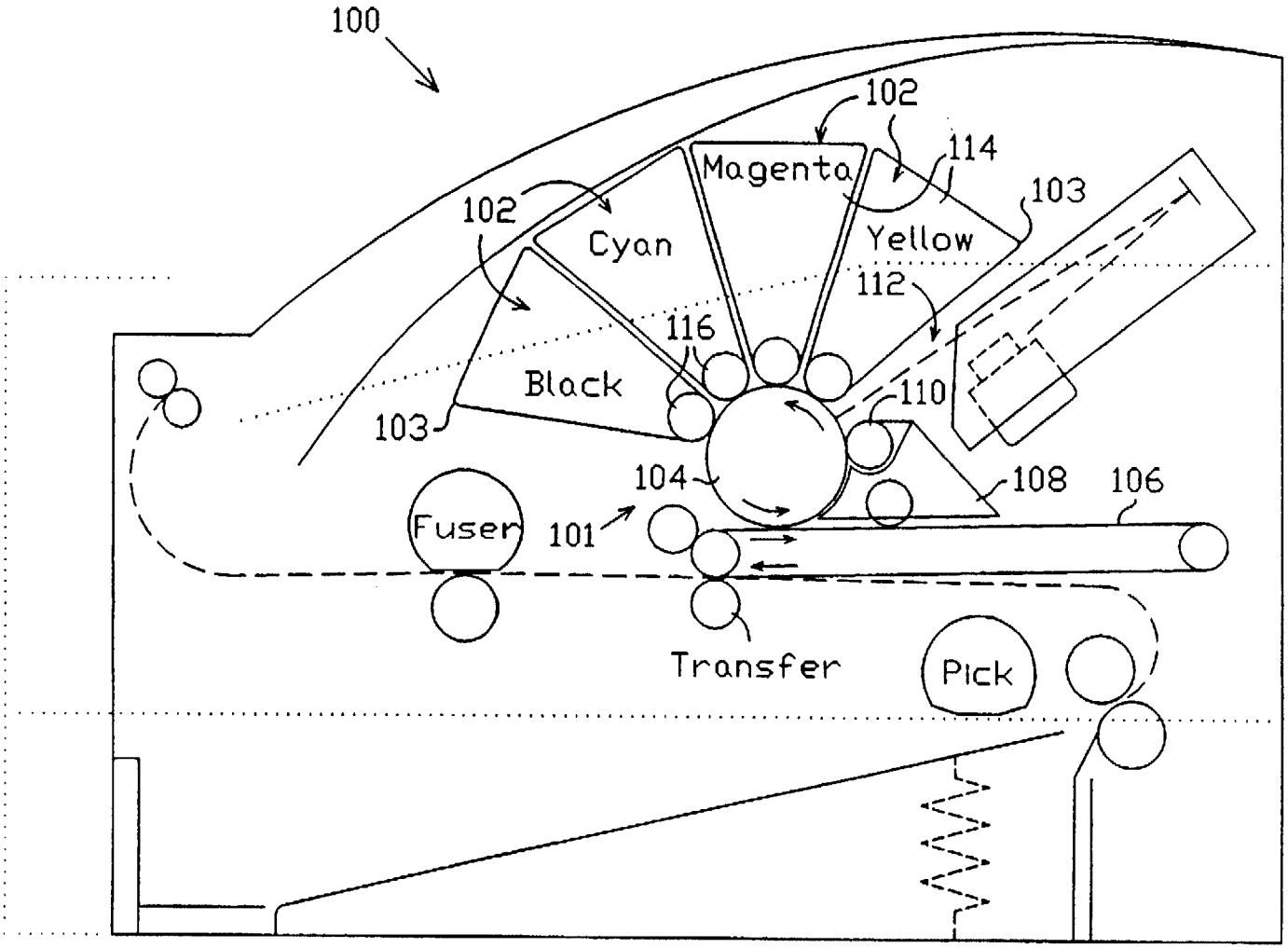
FIG. 8 is a schematic side view of an alternative embodiment of the invented compact EP color development module, a wide V-configuration incorporated into an existing monochrome mid-size engine.

An alternative engine embodiment 100 in FIG. 8 illustrates a wide-V configuration color module 101, retrofit into an existing monochrome midsize engine. The module 101 of FIG. 8 includes a canister which is disposed at an angle <45° relative to horizontal and which has a front outer extremity 103 at approximately 20° relative to the horizontal plane of the OPC drum axis.

The engine 100 includes radially-disposed, wedge-shaped developers 102, a small OPC drum 104, a IT belt 106, waste toner station 108, charging station 110, and laser exposure station 112. As in the preferred embodiment of FIG. 6, the developers are designed to take up a minimum of space, to be individually interchangeable, and to be compatible with a small OPC drum. The wedge shape of the developer canisters 114 allows the canisters 114 to stack closely beside each other, with little space between them. This wedge-shaped design allows the cylindrical electrodes 116, which are radially disposed around less than half of the OPC drum circumference, to be closely adjacent to each other, that is, preferably 1–2 inches apart at their axes. The larger ends of the canisters 114 extend fan-like up from the OPC drum, so that the developers are substantially above and beside, rather than below, the OPC drum 104, charging station 110, and waste station 108.

As in the embodiments of FIGS. 6 and 7, the IT belt 106 of FIG. 8 may be lengthened for various paper platforms. Preferably, the IT belt is sized appropriately at the time of manufacture for the predetermined media and platform size requirements for each printer.

Figure 9:
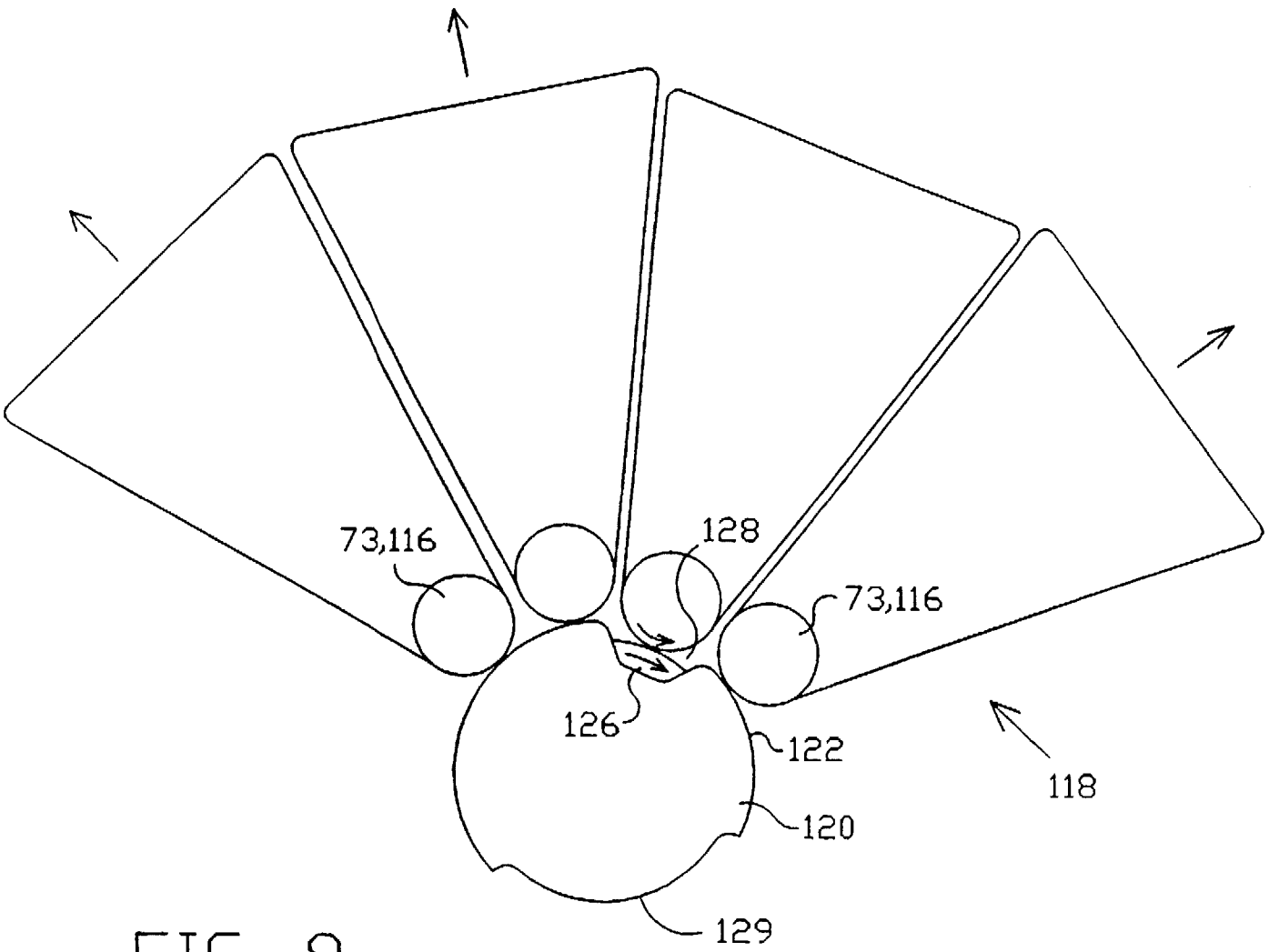
FIG. 9 is a schematic view of one embodiment of a cam system for use with the invented development module.

As shown in FIG. 9, a cam system may be added to the development module to control the distance of the developers from the OPC drum, allowing contact or non-contact with no mechanical or part changes to the engine design. The system 118 comprises two cams 120, one near each end of the photoconductor, the cams having a protruding profile 122 to engage and distance developers away from the OPC drum 126 as needed for a given development method.

An indentation 128 in the cam protruding profile 122, which is roughly the size of the lower end of a developer, allows one developer at a time to drop down to contact, or come very near to, the OPC drum 126 for contact or close-jump-gap development, respectively. The timing and frequency of rotation of both cams 120 are controlled to sequentially move into four positions to allow one developer at a time to develop its respective color plane. After all four color planes have been developed and transferred to the IT belt, the cams 120 are rotated past the second indentation 129 to position them for the next image. Typically, the cam protruding profile 122 pushes the developers a minimum of about 600 microns or greater away from the OPC drum.

When non-contact development is used, the cam system can be rotated to the second indentation 129 which sets the appropriate gap for all four developers to permanently hold all four developers at the appropriate distance from the OPC. Alternatively, in non-contact development, the cam system can be eliminated altogether with few or no other design changes, and the developers can be mounted permanently at an appropriate gap distance from the OPC drum and then switched on and off for development.

In the description and claims, developers and developer sleeves 73, 116 may be described and claimed as being "in close proximity" to the OPC drum across the entire range of development methods, including contact, close-jump-gap, or non-contact (jump-gap) development. In "close proximity" preferably includes distances up to about 600–700 microns distance from the OPC and includes instances when the developers are contacting or close to the OPC drum surface for contact development or close-jump-gap development, cammed away from the OPC for contact development or close-jump-gap development, or distanced for non-contact development.

The internals of the developers are expected to include a variety of conventional designs. Preferably, the developer internals are designed for gravity flow of toner from the interior space of the developer canister to the rotary cylindrical developer. The developer internals may optionally include mixers or pressure regulation and/or seal means to control and meter toner flow to the developers.

Although this invention has been described above with reference to particular means, materials and embodiments, it is to be understood that the invention is not limited to these disclosed particulars, but extends instead to all equivalents within the scope of the following claims.

What is claimed is:

1. A compact, vertically-oriented electrophotographic print engine for placement on a horizontal desk surface, the print engine having a front side, a back side, and a width, the print engine comprising:

a generally cylindrical photoconductor drum having an axis parallel to said print engine width and a circumference with a top half and a bottom half, wherein the photoconductor drum axis lies on a horizontal plane for being parallel to a horizontal desk surface;

a development module comprising a plurality of developers, each developer having a canister disposed above the photoconductor drum and each having a development sleeve in close proximity to said top half of the photoconductor drum; and an intermediate transfer member, a waste toner removal member, and a charging member, all disposed substantially below the photoconductor drum and in close proximity to said bottom half of the drum circumference:

wherein all of the canisters have front and back horizontal extents lying on planes intersecting said drum axis, and wherein all of said planes of the horizontal extents are at angles greater than 45° above said horizontal plane;

wherein said intermediate transfer member is an elongated belt disposed substantially below the photoconductor drum and at an angle between 45°–80° relative to said horizontal plane; and the print engine further comprising a laser scanner having a longitudinal axis, said scanner disposed on a side of the photoconductor drum opposite from said elongated belt with said scanner longitudinal axis disposed at greater than 45 relative to said horizontal plane so that said elongated belt and said scanner form a V-configuration beneath the drum;

whereby the print engine exhibits a small footprint when placed on the desk surface.

2. An electrophotographic print engine as set forth in claim 1, wherein said development sleeves are radially arranged and have centers less than or equal to two inches apart.

3. An electrophotographic print engine as set forth in claim 1, further comprising a cam system for controlling distance of a plurality of said developers from the photoconductor drum, the system comprising a rotatable cam near each end of said drum, each of the cams having a protruding profile contacting a plurality of the developers to distance them from the drum, and each of the cams having a plurality of indentations in said protruding profile for allowing the developers closer to the drum, one of said plurality of indentations being adapted to receive a developer sleeve for allowing one of said developers at a time to contact the drum for contact development while the protruding profile distances the other of said developers from the drum, and another of said plurality of indentations being adapted to receive four developer sleeves at one time to hold four developers at a time at a distance from the photoconductor drum for non-contact development, whereby developer position relative to the drum is controlled by sequenced rotation of the cams.

4. An electrophotographic print engine as set forth in claim 1, wherein the canisters are generally rectangular.

5. An electrophotographic print engine as set forth in claim 1, wherein the canisters are wedge-shaped and disposed radially above the photoconductor drum.

6. A print engine as set forth in claim 1, wherein said photoconductor drum has a diameter of less than 6 inches.

7. An electrophotographic print engine as set forth in claim 3, wherein said development sleeves are radially arranged and have centers less than or equal to two inches apart.

8. An electrophotographic print engine as set forth in claim 3, wherein the canisters are generally rectangular.

9. An electrophotographic print engine as set forth in claim 3, wherein the canisters are wedge-shaped and disposed radially above the photoconductor drum.

10. A print engine as set forth in claim 3, wherein said photoconductor drum has a diameter of less than 6 inches.

11. A compact, vertically-oriented electrophotographic print engine for placement on a horizontal desk surface, the print engine having a front side, a back side, and a width, the print engine comprising:

a generally cylindrical photoconductor drum having an axis parallel to said print engine width and a circumference with a top half and a bottom half, wherein the photoconductor drum axis lies on a horizontal plane for being parallel to a horizontal desk surface;

a development module comprising a plurality of developers, each developer having a canister disposed above the photoconductor drum and each having a development sleeve in close proximity to said top half of the photoconductor drum; and an intermediate transfer member, a waste toner removal member, and a charging member, all disposed substantially below the photoconductor drum and in close proximity to said bottom half of the drum circumference;

wherein all of the canisters have front and back horizontal extents lying on planes intersecting said drum axis, and wherein all of said planes of the horizontal extents are at angles greater than 45° above said horizontal plane;

wherein said intermediate transfer member is an elongated belt disposed substantially below the photoconductor drum and at an angle between 45°–80° relative to said horizontal plane; and the print engine further comprising a cam system for controlling distance of a plurality of said developers from the photoconductor drum, the system comprising a rotatable cam near each end of said drum, each of the cams having a protruding profile contacting a plurality of the developers to distance them from the drum, and each of the cams having a plurality of indentations in said protruding profile for allowing the developers closer to the drum, one of said plurality of indentations being adapted to receive a developer sleeve for allowing one of said developers at a time to contact the drum for contact development while the protruding profile distances the other of said developers from the drum, and another of said plurality of indentations being adapted to receive four developer sleeves at one time to hold four developers at a time at a distance from the photoconductor drum for non-contact development, whereby developer position relative to the drum is controlled by sequenced rotation of the cams;

whereby the print engine exhibits a small footprint when placed on the desk surface and is cammed for both contact development and non-contact development.

12. A compact, vertically-oriented electrophotographic print engine for placement on a horizontal desk surface, the print engine having a front side, a back side, and a width, the print engine comprising:

a generally cylindrical photoconductor drum having an axis parallel to said print engine width and a circumference with a top half and a bottom half, wherein the photoconductor drum axis lies on a horizontal plane for being parallel to a horizontal desk surface;

a development module comprising a plurality of developers, each developer having a canister disposed above the photoconductor drum and each having a development sleeve in close proximity to said top half of the photoconductor drum; and an intermediate transfer member, a waste toner removal member, and a charging member, all disposed substantially below the photoconductor drum and in close proximity to said bottom half of the drum circumference;

wherein all of the canisters have front and back horizontal extents lying on planes intersecting said drum axis, and wherein all of said planes of the horizontal extents are at angles greater than 45° above said horizontal plane;

wherein said intermediate transfer member is an elongated belt disposed substantially below the photoconductor drum and at an angle between 45°–80° relative to said horizontal plane and has front and back horizontal extents that do not extend horizontally out further than said cannister front and back horizontal extents;

whereby the print engine exhibits a small footprint when placed on the desk surface.

* * * * *